US006298840B1

(12) United States Patent
Kerns

(10) Patent No.: US 6,298,840 B1
(45) Date of Patent: Oct. 9, 2001

(54) AIR/FUEL CONTROL SYSTEM AND METHOD

(75) Inventor: James Michael Kerns, Trenton, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/609,529

(22) Filed: Jul. 3, 2000

(51) Int. Cl.[7] ..... F02D 41/14

(52) U.S. Cl. ..... 123/681; 123/478; 123/674; 73/117.3; 60/285

(58) Field of Search ..... 123/681, 478, 123/480, 690, 693, 694, 674, 698; 60/285, 274, 276; 73/117.3; 701/109, 114

(56) References Cited

U.S. PATENT DOCUMENTS 4,046,118 * 9/1977 Aono ..... 123/683
4,170,969 * 10/1979 Asano ..... 123/680
4,248,196 * 2/1981 Toelle ..... 123/680
4,359,991 * 11/1982 Stumpp et al. ..... 123/478
4,625,698 * 12/1986 Jamrog ..... 123/696
5,024,199 * 6/1991 Abe ..... 123/674
5,230,322 * 7/1993 Curran et al. ..... 123/694
5,237,983 * 8/1993 Willey et al. ..... 123/688
6,102,018 * 8/2000 Kerns et al. ..... 123/674

* cited by examiner

*Primary Examiner*—Henry C. Yuen
*Assistant Examiner*—Hieu T. Vo
(74) *Attorney, Agent, or Firm*—John F. Buckert; Allan J. Lippa

(57) ABSTRACT

A method and system is provided for improving the adjustment of fuel levels delivered to an internal combustion engine. A controller 15 calculates commanded air-fuel levels to deliver to the engine 13 based on a plurality of control signals, including air-fuel ratio signals measured by an air-fuel sensor 54 in the exhaust stream downstream of the engine 13. Systematic errors that reduce the accuracy of the commanded air-fuel level, including systematic errors associated with air-fuel ratio measurements, are identified and compensated for according to the present invention. Statistical methods and known operational characteristics of the air-fuel sensor are used to attribute a portion of the total system fuel error to air-fuel ratio measurement errors and such errors are compensated for to permit the calculation of a more accurate commanded air-fuel level.

20 Claims, 4 Drawing Sheets

AIR/FUEL CONTROL SYSTEM AND METHOD

FIELD OF THE INVENTION

The invention relates generally to electronic air/fuel control of internal combustion engines using feedback data from exhaust gas oxygen (UEGO) sensor(s) positioned in the exhaust stream. Specifically, this invention relates to a system and method for estimating and compensating for systematic errors in connection with air/fuel control, particularly with respect to systematic measurement errors resulting from the UEGO sensor(s).

BACKGROUND OF THE INVENTION

A variety of engine air/fuel control systems are known in which fuel delivered to the engine is adjusted in response to the output of one or more UEGO sensors, often to maintain an average air/fuel ratio at a stoichiometric value. Examples of such systems are disclosed in U.S. Pat. Nos. 5,255,512 and 5,282,360. Such systems may also include a fuel vapor recovery system wherein fuel vapors are purged from the fuel system into the engine's air/fuel intake. An example of such a system is disclosed in U.S. Pat. No. 5,048,493. Generally in these systems, an electronic controller calculates desired air/fuel levels over time based upon certain engine operating parameters and system measurements. One such system measurement is the oxygen content in the exhaust stream provided as feedback data by one or more UEGO sensors. Based on the calculated desirable air/fuel level, the electronic controller provides a control signal to the engine's fuel injectors to deliver a certain level of fuel to the engine cylinders. The control signal corresponds to a commanded or desirable air/fuel level.

A number of systematic errors are present in such systems that affect the accuracy of the air/fuel levels delivered to the engine cylinders. That is, the collective effects of a variety of systematic errors in the system cause the actual air/fuel levels delivered to the engine cylinders to vary from the calculated desirable air/fuel levels. These systematic errors may result from certain inaccuracies of the measurements derived from the UEGO sensor(s), airflow sensor(s) and other sensors in the system that provide feedback signals to the electronic controller. Also, a systematic fuel flow error resulting from variations in the level of fuel delivered by different fuel injectors in response to the same control signal may affect the accuracy of fuel delivery to the engine cylinders. Another type of systematic error results from variations in the composition of the fuel vapor and air mixture from the vapor recovery system. The collective effect of these various individual sources of error is considered the total system fuel error.

It is desirable for the system to monitor and correct for its systematic errors to achieve optimal air/fuel levels. However, even though the functional characteristics of certain system components under various operating conditions are predictable, until the present invention it has been difficult or impossible to correct for these systematic errors when using UEGO sensors because their respective individual contributions to the total system fuel error are undetectable. While it is generally known, for example, that variations in the internal gas diffusion rates from one UEGO sensor to another result in measurement errors that tend to vary linearly with the oxygen content of the exhaust gas, the inventor herein has recognized that this known operational characteristic can be used to correct for systematic UEGO sensor errors only if the UEGO errors can be apportioned from the other systematic errors that comprise the total system fuel error.

SUMMARY OF THE INVENTION

An object of the present invention is to provide an improved system and method for controlling the air/fuel ratio in the system. The present invention uses statistical methods to estimate and account for systematic errors in the fuel delivery system. Specifically regarding the systematic error associated with UEGO sensors, the present invention uses statistical methods to estimate the portion of the total system fuel error that is attributable to systematic UEGO sensor errors based on operating parameters of the engine. That is, the systematic UEGO error is apportioned from the total system fuel error. Then, the known operating characteristics of UEGO sensors in general are used to correct for the systematic UEGO sensor errors when calculating the commanded or desirable air/fuel ratio to be provided to the engine cylinders. The statistical methods used to update the estimates of the errors are applied at those times when the engine operating conditions, and thus the parameters used in the statistical estimates, are varying. The present invention improves the system's ability to more accurately calculate desired or commanded fuel levels in the engine cylinders to improve emission control, fuel economy, and the like. These and other objects and objects and benefits of the present invention will be apparent to those skilled in the art.

BRIEF DESCRIPTION OF THE DRAWINGS

1.

2.

3.

DESCRIPTION OF A PREFERRED EMBODIMENT

Figure 1:
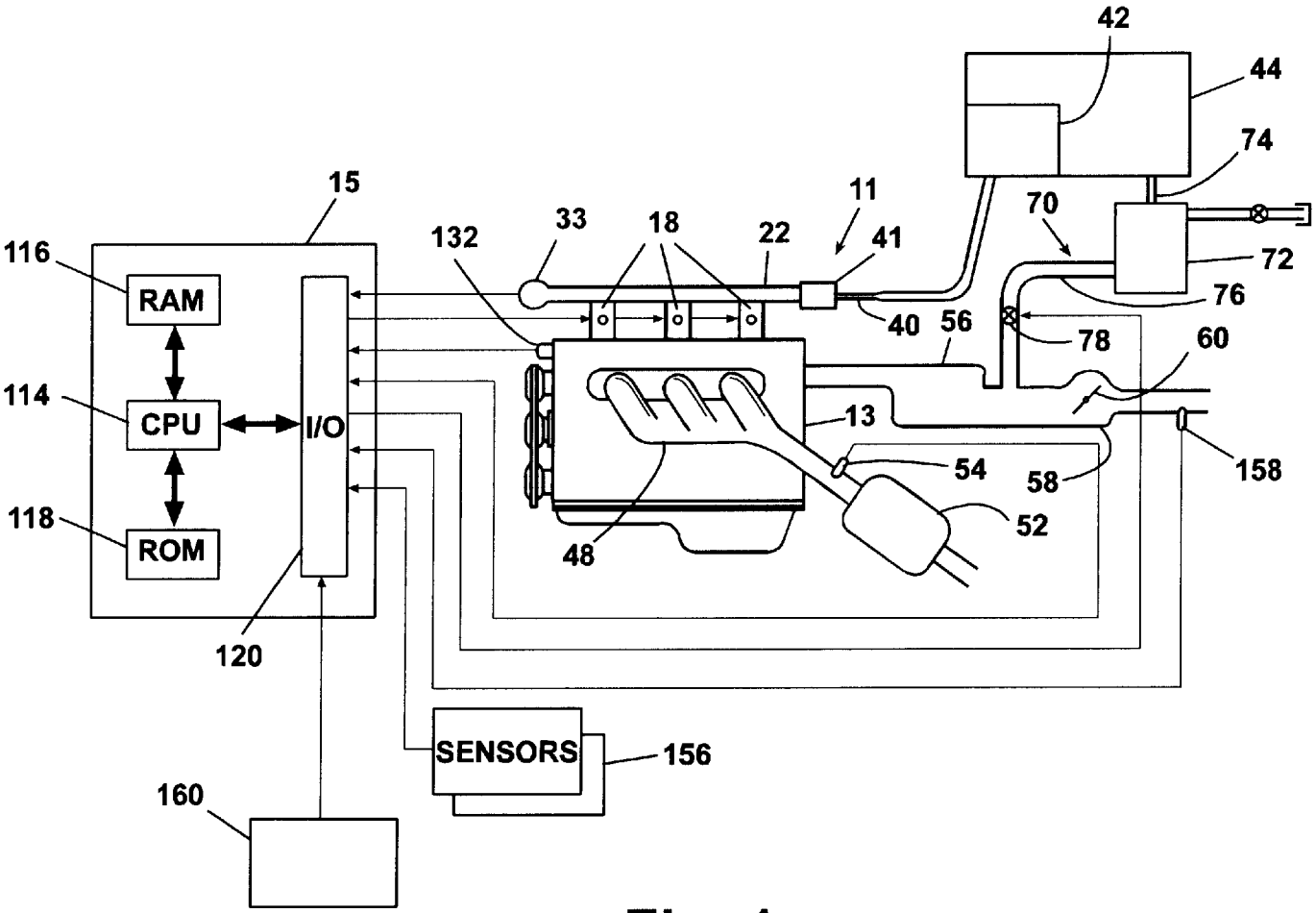
FIG. 1 is an illustration of a representative internal combustion engine according to a preferred embodiment of the invention.

Fuel delivery system 11, shown in FIG. 1, of a conventional automotive internal combustion engine 13 is controlled by controller 15, such as an EEC or PCM. Engine 13 comprises fuel injectors 18, which are in fluid communication with fuel rail 22 to inject fuel into the cylinders (not shown) of engine 13, and temperature sensor 132 for sensing temperature of engine 13. Fuel delivery system 11 has fuel rail 22, fuel rail pressure sensor 33 connected to fuel rail 22, fuel line 40 coupled to fuel rail 22 via coupling 41, fuel delivery system 42, which is housed within fuel tank 44, to selectively deliver fuel to fuel rail 22 via fuel line 40.

Engine 13 also comprises exhaust manifold 48 coupled to exhaust ports of the engine (not shown). Catalytic converter 52 is coupled to exhaust manifold 48. A conventional exhaust gas oxygen sensor 54 is positioned upstream of catalytic converter 52 in exhaust manifold 48. Engine 13 further comprises intake manifold 56 coupled to throttle body 58 having throttle plate 60 therein. Intake manifold 56 is also coupled to vapor recovery system 70.

Vapor recovery system 70 comprises charcoal canister 72 coupled to fuel tank 44 via fuel tank connection line 74. Vapor recovery system 70 also comprises vapor control valve 78 positioned in intake vapor line 76 between intake manifold 56 and charcoal canister 72.

Controller 15 has CPU 114, random access memory 116 (RAM), computer storage medium 118 (ROM), having a computer readable code encoded therein, which is an electronically programmable chip in this example, and input/output (I/O) bus 120. Controller 15 controls engine 13 by receiving various inputs through I/O bus 120, such as fuel pressure in fuel delivery system 11, as sensed by pressure sensor 33; relative exhaust air/fuel ratio as sensed by UEGO sensor 54, temperature of engine 13 as sensed by temperature sensor 132, measurement of inducted mass airflow (MAF) from mass airflow sensor 158, speed of engine (RPM) from engine speed sensor 160, and various other sensors 156. Controller 15 also creates various outputs through I/O bus 120 to actuate the various components of the engine control system. Such components include fuel injectors 18, fuel delivery system 42, and vapor control valve 78. It should be noted that the fuel may be liquid fuel, in which case fuel delivery system 42 is an electronic fuel pump.

Fuel delivery control system 42, upon demand from engine 13 and under control of controller 15, pumps fuel from fuel tank 44 through fuel line 40, and into pressure fuel rail 22 for distribution to the fuel injectors during conventional operation. Controller 15 controls fuel injectors 18 to maintain a desired air/fuel ratio in response to UEGO sensor 54, as well as other input parameters. Controller 15 measures exhaust air/fuel ratio from the output of universal exhaust gas oxygen sensor (UEGO) 54, which has a substantially linear relation to the actual exhaust air/fuel ratio. In particular, UEGO sensor 54 provides a signal that varies with the measured air-fuel ratio over a broad range of air-fuel ratios. This broad range of air-fuel ratios is generally much greater than that of so called EGO or HEGO sensors, which change from lean to rich in less than a range of one air-fuel ratio. For example, the broad range of air-fuel ratios for a UEGO sensor can be from between 9:1 to 30:1.

Figure 2:
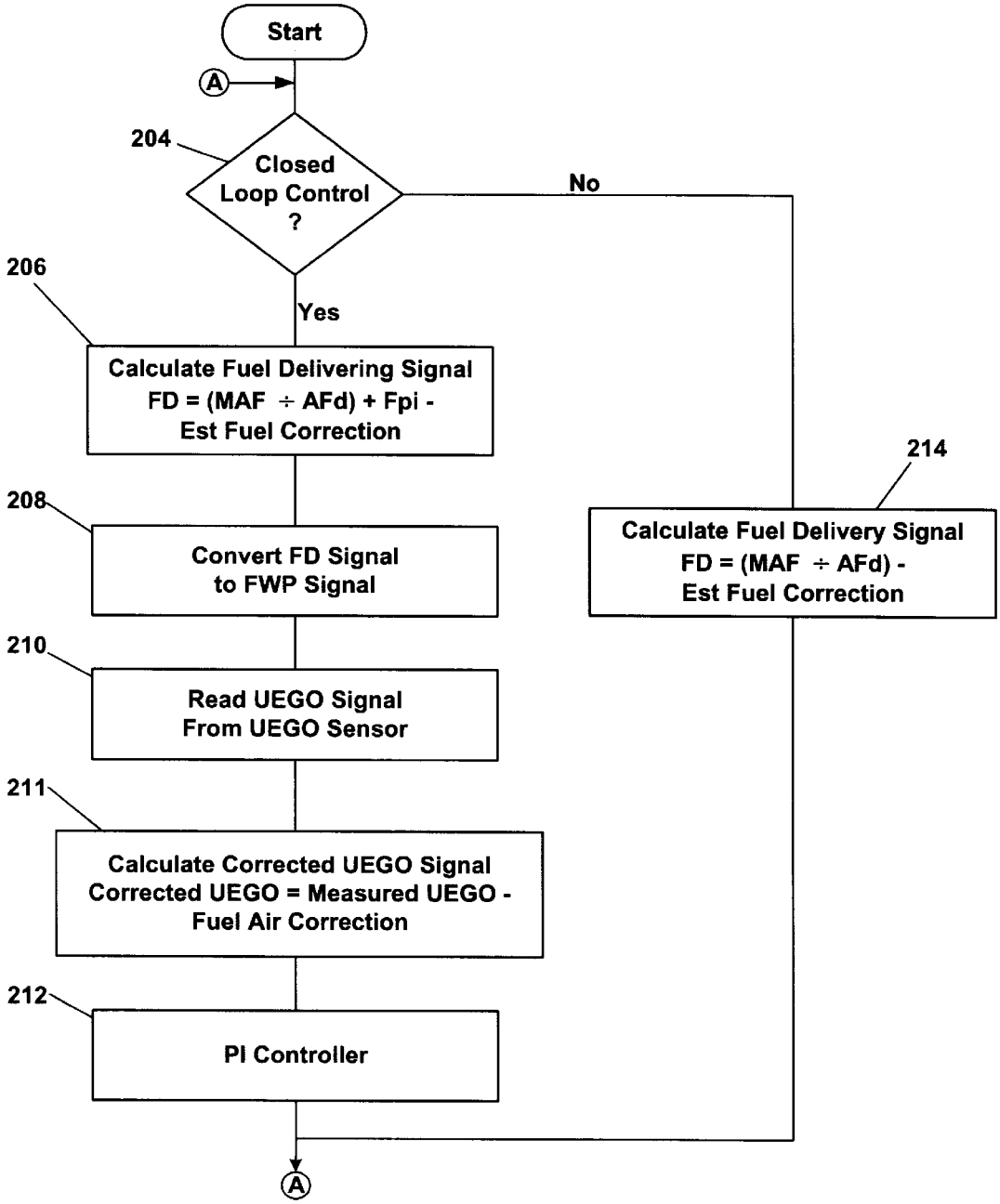
FIG. 2 is a flowchart illustrating a first portion of the method according to a preferred embodiment of the invention.

Referring now to FIG. 2, a flowchart of a preferred routine performed by controller 15 to calculate the fuel pulse width signal (FPW) is now described. Fuel pulse width signal (FPW) is the signal sent by controller 15 to fuel injectors 18 to deliver the desired quantity of fuel to engine 13. A determination is first made whether closed-loop air/fuel control is to be commenced (step 204) by monitoring engine operation conditions such as temperature. When closed-loop control commences, the desired fuel delivery (FD) is calculated by dividing the mass air flow (MAF) by the desired air/fuel ratio term Afd and adding feedback correction term Fpi and subtracting learned fuel error term EstFuelCorrection as shown in step 206. In step 208, the signal FD is converted to fuel pulse width signal FPW representing a time to actuate fuel injectors 18, which corresponds to a desired or commanded fuel level to be delivered to the engine cylinders. In step 210, signal UEGO, corresponding to an oxygen content in the exhaust stream, is read from UEGO sensor 54. The output of UEGO sensor 54 corresponds to the measured air-fuel ratio in the exhaust stream downstream of the engine. The UEGO signal is corrected based on a Fuel Air Correction term described herein below in step 211, and subsequently processed in a proportional plus integral controller, as described hereinafter and as is known in the art.

Referring to step 212, the corrected UEGO signal is subtracted from signal Afd and then multiplied by a gain constant GI, and the resulting product is added to products previously accumulated ($GI*(Afd_{i-1}-UEGO_{i-1})$). Stated another way, the difference between signal UEGO and Afd is integrated each sample period (i) in steps determined by gain constant GI. Next, the corrected UEGO signal is also multiplied by a gain GP. Finally, an integral value is added to a proportional value, as is known in the art, to generate fuel trim signal Fpi, which is used to calculate desired fuel delivery signal FD as described above. When open-loop control is used, the signal FD is calculated by dividing MAF by the desired air/fuel ratio term Afd and subtracting learned fuel error term EstFuelCorrection, as shown in step 214.

Figure 3:
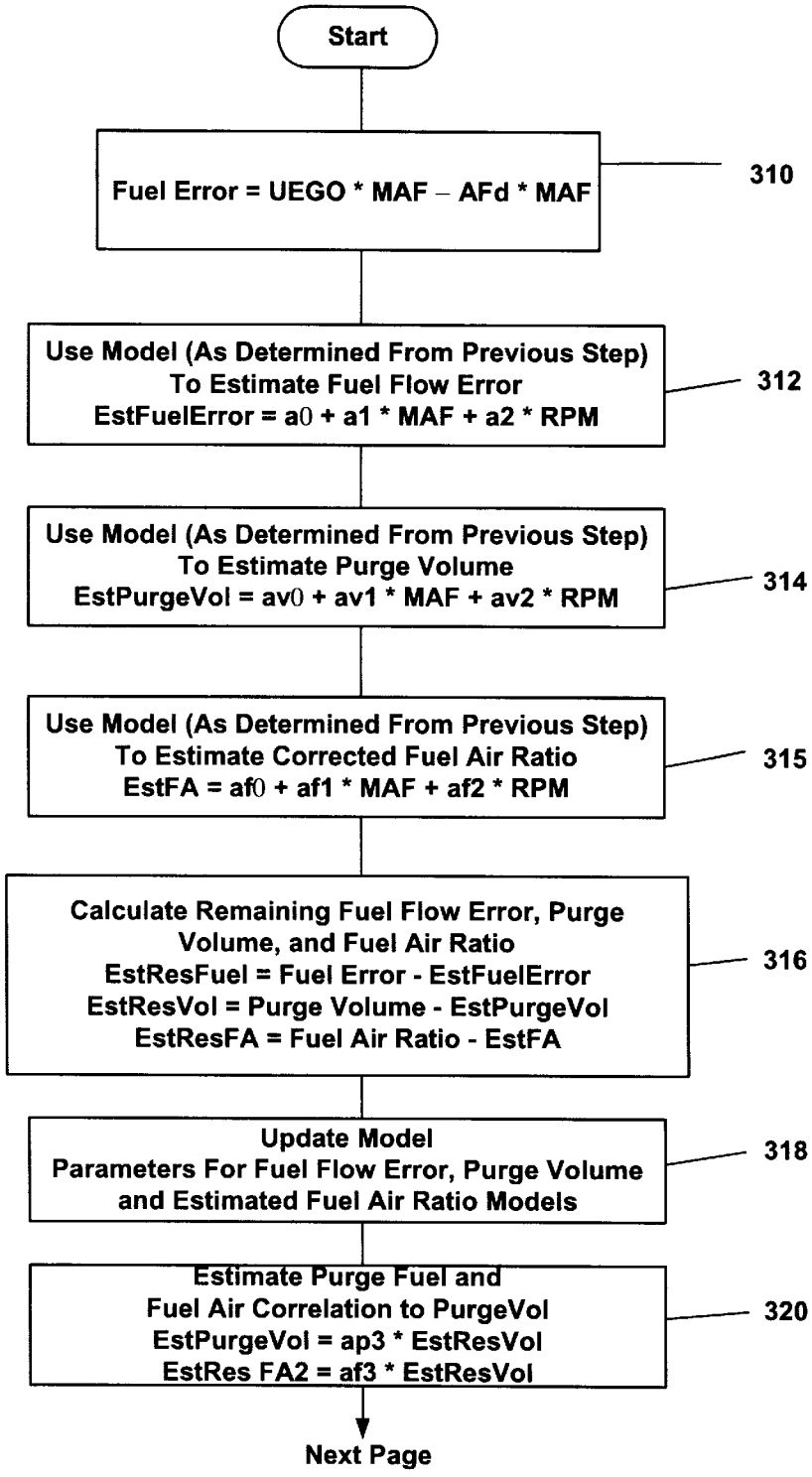
FIG. 3 is a flowchart illustrating a second portion of the method according to a preferred embodiment of the invention.
Figure 3:
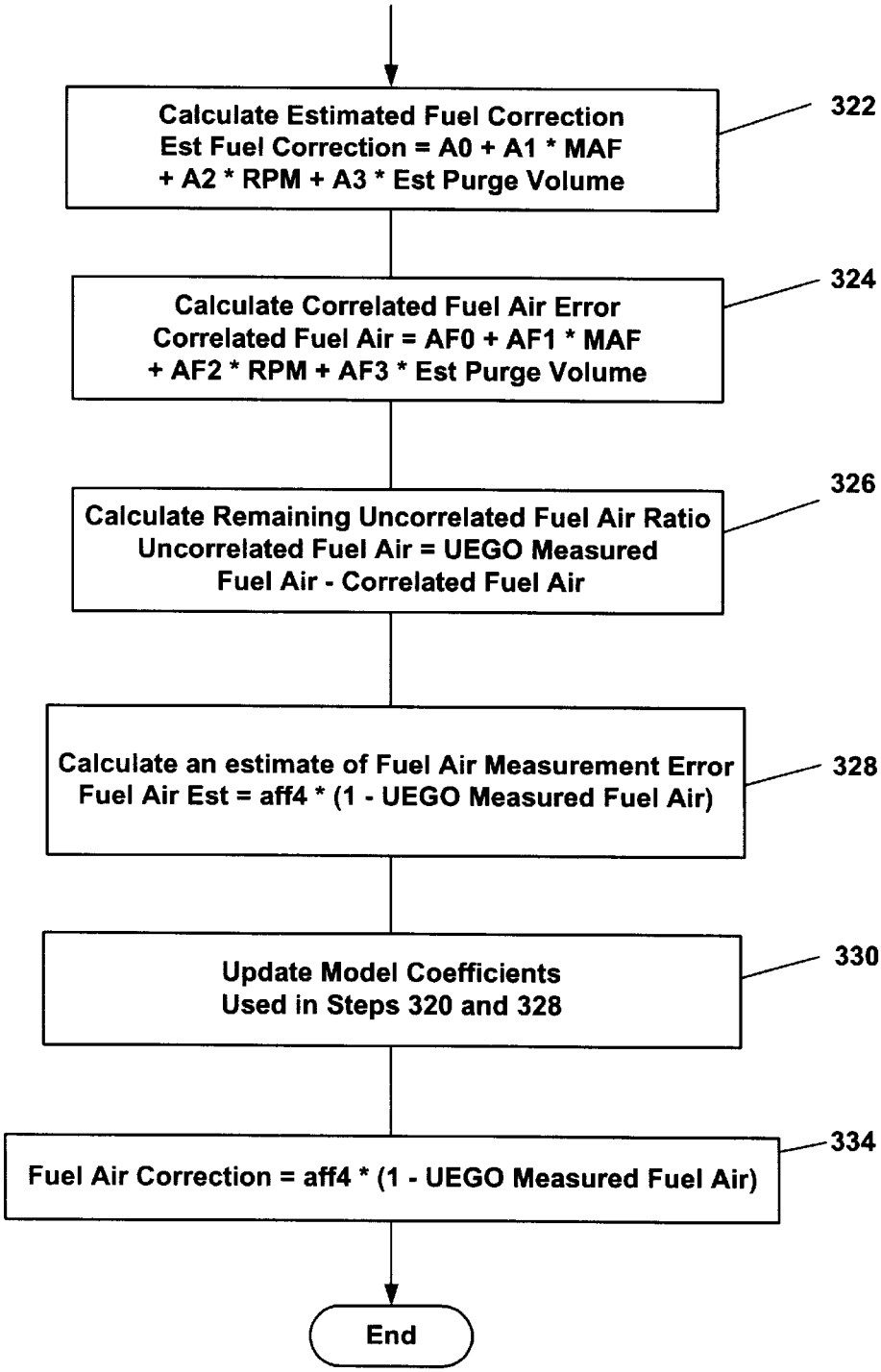

Referring now to FIG. 3, a flowchart of a routine performed by controller 15 to generate the learned fuel error term EstFuelCorrection used in steps 206 and 214 and the FuelAirCorrection term used in step 211 is now described according to a preferred embodiment of the invention. The learned fuel error term, EstFuelCorrection, incorporates corrections for the systematic errors described above, including any systematic error associated with the UEGO sensor measurements. The routine of FIG. 3 is preferably only performed when there is sufficient variation in engine operating conditions, such as for example RPM and MAF. Also, the system's purge flow is preferably modulated during execution of this portion of the routine so as to vary the purge flow from zero to the maximum possible flow. Additionally, the updates to the air-fuel ratio error estimates (described hereinafter) are preferably performed only when there is sufficient variation in the commanded air-fuel ratio provided to the engine cylinders. For vehicles equipped with a NOx trap type catalyst, the air-fuel ratio will generally be sufficiently modulated during lean operation as part of the NOx trap purge routine.

In step 310 of FIG. 3, the total system fuel error term, FuelError, is calculated as the difference between the actual air-fuel ratio measured by the UEGO sensor 54 and the desired air-fuel ratio Afd, where the difference is multiplied by the mass air flow signal MAF. The FuelError term represents the difference between the fuel flow that was commanded by the controller 15 and that which was determined from the measured fuel air ratio and mass air flow. It represents the total system fuel error, and it is comprised of error contributions from various sources.

Next, in step 312, a fuel error model is used to estimate the portion of the FuelError that is associated with the fuel flow of the system, in particular those errors associated with the fuel flow through the fuel injectors. The fuel error model is based on model parameters that were estimated during the previous iteration of the routine. In other words, the fuel error model is updated every iteration of the routine, and during each iteration, the fuel error model is used to estimate or predict a fuel flow error. The estimated fuel flow error, EstFuelError, is calculated as the sum of model parameter a0, model parameter a1 multiplied by the mass air flow signal MAF, and model parameter a2 multiplied by the engine rpm signal RPM. Engine operating signals MAF and RPM are obtained from mass airflow sensor 132 and engine speed sensor 160, respectively. The model parameters a0 through a2 are the model parameters that were updated during the previous iteration of the routine. As described later herein, with particular reference to step 318, the model parameters a0 through a2 will be updated each time the routine is executed.

Next, as shown in step 314, a purge volume model is used to estimate the portion of the purge flow entering engine 13 that correlates with the engine operating signals, MAF and RPM, used in step 312. The purge volume model is used in a similar way as the fuel error model in that the purge volume model is updated during each iteration of the routine as will be described later herein with particular reference to step 318. The estimated purge volume, EstPurgeVol, is calculated as the sum of model parameter avo, model parameter av1 multiplied by the signal MAF, and model parameter av2 multiplied by the signal RPM. Again, the model parameters av0 through av2 represent the values of the purge volume model parameters that were updated during the previous iteration of the routine.

In step 315, an estimated air-fuel ratio, EstAF, is calculated using an estimated air-fuel ratio model comprising the same engine parameter signals, MAF and RPM, used in steps 312 and 314 above and estimated air fuel ratio model parameters af0, af1 and af2. Specifically, the estimated air fuel ratio, EstAF, is calculated as the sum of model parameter af0, model parameter af1 multiplied by the signal MAF, and model parameter af2 multiplied by signal RPM. As before, the estimated air fuel ratio model parameters af0 through af2 are the model parameters that were updated during the previous iteration of the routine. The model parameters af0 through af2 are updated in step 318 with each execution of the routine. The estimated air fuel ratio, EstAF, represents an estimate of the actual air-fuel ratio in the exhaust system that correlates with the engine parameters MAF and RPM.

At step 316, the controller 15 calculates the residual or remaining error, EstResFuel, that was not explained by the estimated fuel error, EstFuelError, calculated in step 312 as the FuelError minus the EstFuelError. The controller also calculates the estimated residual purge flow volume, EstResVol, not explained in step 314, and the residual or remaining variation, EstResFA, in the fuel air ratio not explained in step 315. The remaining purge flow EstResVol is calculated as the PurgeVolume minus the EstPurgeVol. The PurgeVolume term is calculated based on a commanded duty cycle output to the purge valve and expected flow characteristics of the purge valve, as is well-known in the art. The remaining variation in the fuel air ratio, EstResFA, is calculated as the fuel-air ratio measured by the UEGO sensor 54, FuelAirRatio, minus the EstFA calculated in step 315. The EstResFuel error and EstResVol error will both be used as described later herein, with particular reference to step 320, to further update the total fuel error model. The EstResFA error will also be used as described later herein, with particular reference to step 320, to further update the air-fuel ratio error model. The purpose of step 316 is to determine the portions of the various identified errors that are residual or unexplained by the respective error models used in steps 312, 314 and 315.

In step 318, the residual or unexplained errors in the various error models are used to update the respective model parameters. Specifically, the remaining fuel error, EstResFA, is used to update the fuel error model, the remaining purge volume, EstResVol, is used to update the purge volume model and the remaining variation in the fuel air ratio, EstResFA, is used to update the estimated fuel air ratio model. This is done using two techniques known to those skilled in the art as the Recursive Least Squares Method and Multiple Linear Regression. These methods are described in detail in the book titled, "Multiple Linear Regression" by Draper and Smith and the book titled, "Digital Control of Dynamic Systems", by Franklin and Power. Thus, the parameters a0, a1, and a2 represented by the matrix AA, the parameters av0, av1, and av2, represented by the matrix AV, and the parameters af0, af1, and af2, represented by the matrix AF are recalculated according to the following equations:

$$A=A_{i-1}+(L*Y)-(X*A)$$

where: X is a matrix containing the estimated system parameters, Y is a matrix containing measured system parameters, Y=AX, and L is a gain matrix which is calculated from the equation:

$$L=\frac{(P/\Upsilon)*X}{(1/\alpha)+(X'*(P/\Upsilon)*X)}$$

where P is the weighted inverse sum of squares of all previous observed system states, Y and $\alpha$ are exponential weighting terms related by $\alpha$=1−Y, and X' represents the transpose of the matrix X. In particular, with reference to steps 312, 314, and 315, X is a vector composed of a constant value of 1, MAF, and RPM. Matrix A represents either AA, AV or AF, and Y represents either FuelError, PurgeVolume, or AirFuelRatio when performing the updates for the model parameters of steps 312, 314 and 315 respectively.

In step 320, the EstResVol error calculated in step 316 is used in a model to estimate the fuel delivered from the purge system using a model parameter ap3 that had been updated during the previous iteration of the routine. Parameter ap3 is updated during each iteration of the routine in step 330 using the EstResVol and EstResFuel values according to the method described in step 318 herein. Similarly, the correlation (EstResFA2) between the air fuel ratio and purge volume is estimated in step 320 based on the EstResVol value and the previously-updated parameter af3. Parameter af3 is updated in step 330 during each execution of the routine using the method described above in connection with step 318 with the EstResAF and EstResVol values used as the Y and X vectors, respectively.

Now, in step 322, the model parameters used in steps 312, 314 and 320 are combined to form a single fuel error correction model:

$$\text{EstFuelCorrection}=A0+A1*\text{MAF}+A2*\text{RPM}+A3*\text{EstPurgeVolume}$$

where:

A0=aa0−ap3*av0

A1=aa1−ap3*av1

A2=aa2−ap3*av2

A3=ap3

Similarly, a single estimate of the correlated fuel air ratio is calculated in step 324 using the model parameters from steps 314, 315 and 320:

$$\text{CorrelatedFuelAir}=AF0+AF1*\text{MAF}+AF2*\text{RPM}+AF3*\text{EstPurgeVolume}$$

where:

A0=aff0−aff3*av0

A1=aff1−aff3*av1

A2=aff2−aff3*av2

A3=aff3

The calculations of the EstFuelCorrection and CorrelatedFuelAir terms in steps 322 and 324 take into consideration systematic errors associated with fuel flow and purge flow.

Before assigning a portion of the total system fuel error to the measurement errors of the UEGO sensor, the controller 15 determines the amount of uncorrelated fuel air ratio error residuals (UncorrelatedFuelAir), as shown in step 326. The UncorrelatedFuelAir term is calculated by subtracting the CorrelatedFuelAir from step 324 from the air-fuel ratio measured by the UEGO sensor 54.

As shown in step 328, a fuel-air ratio error model (FuelAirEst) is used to estimate the systematic error associated with the UEGO sensor(s). Like the fuel error model and purge volume model described hereinabove, the FuelAirEst model is based on a parameter aff4 that is estimated during the previous iteration of the routine. The estimated systematic UEGO error (FuelAirEst) is calculated using the well-known Least Squares technique described hereinabove according to the following model:

$$\text{FuelAirEst}=aff4*(1-\text{UEGO})$$

where aff4 is a statistically-estimated parameter that correlates with engine operating conditions and wherein the uncorrelated fuel air error residuals calculated in step 326 are used as the measured system parameter Y. The UEGO term represents the fuel-air ratio (the inverse of the air-fuel ratio) measured by the UEGO sensor 54, normalized relative to the UEGO sensor's known fuel-air output at stoichiometry. The fuel-air error model is derived from the known fact that the systematic error associated with UEGO sensors is zero at stoichiometry and increases linearly as the measured fuel-air ratio moves away from stoichiometry.

In step 330 of FIG. 3, the model parameters used in steps 320 and 328 are updated using the Recursive Least Squares Method and Multiple Linear Regression techniques described in connection with step 318. Model parameter ap3 is updated using the EstResVol and EstResFuel values as the X and Y vectors along with a P matrix associated with the EstResVol. Similarly, parameter af3 is updated using EstResVol and EstResAF as the X and Y vectors respectively.

In step 334 of FIG. 3, an updated value of the model parameter FuelAirEst from step 328 is used to predict the term FuelAirCorrection used by the routine in step 211 of FIG. 2. The updated FuelAirCorrection term is calculated by the controller 15 as the model parameter aff4 (as updated in step 330) multiplied by the difference between one and the measured FuelAir value. The updated FuelAirCorrection term is used in step 211 of FIG. 2 to adjust the air-fuel ratio measured by the UEGO sensor to compensate for systematic errors in the UEGO sensor measurements. These errors result from variations in measurement outputs from one UEGO sensor to another, as well from variations in the measurement outputs from the same UEGO sensor as it wears over time.

The disclosed invention permits systematic errors in the fuel control and delivery system to be detected, apportioned and compensated for. In particular, the present invention permits an appropriate portion of the total system fuel error to be allocated to systematic errors associated with measurement outputs of UEGO sensors and for those errors to be compensated for when calculating a commanded air-fuel level to be delivered to the engine cylinders. Accordingly, the present invention results in, among other things, more efficient fuel control in the system.

While preferred embodiments of the present invention have been described herein, it is apparent that the basic construction can be altered to provide other embodiments which utilize the processes and compositions of this invention. Therefore, it will be appreciated that the scope of this invention is to be defined by the claims appended hereto rather than by the specific embodiments that have been presented hereinbefore by way of example.

What is claimed is:

1. An air-fuel ratio control system for an internal combustion engine, comprising:

an exhaust sensor for indicating a measured exhaust air-fuel ratio of exhaust gas exiting the engine; and a controller for obtaining a measured air-fuel ratio signal from said sensor, calculating a fueling difference in response to a difference between a commanded air-fuel ratio and said measured exhaust air-fuel ratio, and assigning a first portion of said fueling difference to a sensor measurement error based on engine operating conditions, calculating a sensor correction signal based on said sensor measurement error, and adjusting a level of fuel supplied to the engine based on said sensor correction signal.

2. An air-fuel ratio control system for an internal combustion engine, comprising:

an exhaust sensor that provides an output signal that varies across a predetermined broad air-fuel range, said output signal corresponding to a measured exhaust air-fuel ratio of exhaust gas exiting the engine; and a controller for obtaining a measured air-fuel ratio signal from said sensor, calculating a fueling difference in response to a difference between a commanded air-fuel ratio and said measured exhaust air-fuel ratio, assigning a first portion of said fueling difference to a sensor measurement error based on engine operating conditions, calculating a sensor correction signal based on said sensor measurement error, and adjusting a level of fuel supplied to the engine based on said sensor correction signal.

3. The system recited in claim 2 wherein said predetermined broad range is at least two air/fuel ratios.

4. A method for estimating an air-fuel measurement error by an exhaust gas sensor coupled to an internal combustion engine, comprising the steps:

obtaining a measured air-fuel ratio signal from the sensor;

calculating a fueling difference in response to a difference between a commanded air-fuel ratio and a measured exhaust air-fuel ratio;

allocating a first portion of said fueling difference to a sensor measurement error based on engine operating conditions.

5. The method of claim 4, further comprising the step of allocating at least a second portion of said fueling difference to a second source of systematic error based on said engine operating conditions.

6. The method of claim 5, wherein said second source of systematic error is selected from an estimated purge flow error and a fuel flow error.

7. The method of claim 5, wherein said engine operating conditions are selected from engine speed, engine airflow, and purge vapor flow.

8. The method of claim 5 wherein said first portion of said fueling difference is allocated based on a degree of statistical correlation between said second source of systematic error and either said commanded air-fuel ratio or said measured air-fuel ratio.

9. A method of adjusting a quantity of fuel provided to cylinders of an internal combustion engine, comprising the steps:

obtaining a measured air-fuel ratio signal from a sensing device positioned to measure an air-fuel ratio in an exhaust stream downstream of the engine;

determining a corrected air-fuel ratio signal corresponding to said exhaust stream based on said measured air-fuel ratio signal;

calculating a commanded fuel quantity signal based on said corrected air-fuel ratio signal; and adjusting the quantity of fuel provided to the cylinders based on said commanded fuel quantity signal.

10. The method of claim 9, wherein said step of determining a corrected air-fuel signal is based on known operating characteristics of said sensing device.

11. The method of claim 10, further comprising the step of calculating an air-fuel difference between a commanded air-fuel ratio and a measured exhaust air-fuel ratio.

12. The method of claim 11, further comprising the step of assigning a first portion of said fueling difference to a sensor measurement error based on engine operating conditions.

13. The method of claim 12, wherein said sensing device is an oxygen sensor.

14. The method of claim 12, wherein said step of determining a corrected air-fuel ratio signal comprises multiplying a model parameter signal by a mathematical difference between the inverse of said measured air-fuel ratio signal and a stoichiometric fuel-air ratio signal.

15. The method of claim 14, wherein said step of determining a corrected air-fuel ratio signal further comprises estimating said model parameter signal using statistical methods.

16. The method of claim 15, wherein said statistical methods comprise the Recursive Least Squares Method and Multiple Linear Regression.

17. The method of claim 15, wherein said step of determining a corrected air-fuel ratio signal comprises the steps:

calculating an air-fuel ratio error signal based on the mathematical difference between said measured air-fuel ratio signal and a commanded air-fuel ratio signal;

determining an air-fuel error correlation that corresponds to a statistical correlation between said air-fuel ratio error signal and at least one of said measured air-fuel ratio signal or said commanded air-fuel ratio signal.

18. The method of claim 17, wherein:

said step of adjusting the quantity of fuel provided to the cylinders is further based on at least one error adjustment signal other than said corrected air-fuel ratio signal; and said step of determining a corrected air-fuel ratio signal is further dependent upon a statistical correlation, if any, between said air-fuel ratio error signal and said error adjustment signal.

19. The method of claim 18, wherein said error adjustment signal corresponds to a purge flow signal associated with a vapor recovery system.

20. The method of claim 18, wherein said error adjustment signal corresponds to a fuel flow error signal that estimates a difference between a commanded fuel delivery level and an actual fuel delivery level in the cylinders.

* * * * *